US005277179A

United States Patent [19]

Stone et al.

[11] Patent Number: 5,277,179

[45] Date of Patent: Jan. 11, 1994

[54] DIVER'S MICROPHONE MASK

[75] Inventors: Mark Stone, Victoria, Canada; Soren Uhre, Tampere, Finland

[73] Assignee: Stone Electronics Ltd., Victoria, Canada

[21] Appl. No.: 941,802

[22] Filed: Sep. 8, 1992

[30] Foreign Application Priority Data

Aug. 4, 1992 [CA] Canada ..... 2075447

[51] Int. Cl.[5] ..... A62B 18/08

[52] U.S. Cl. ..... 128/201.19; 128/201.27; 128/206.24; 128/206.29

[58] Field of Search ..... 128/201.19, 204.26, 128/201.27, 201.28, 206.24, 206.29

[56] References Cited

U.S. PATENT DOCUMENTS

| | | | |
|---|---|---|---|
| 3,123,680 | 3/1964 | Minton, Jr. et al. | 128/201.19 |
| 3,292,618 | 12/1966 | Davis et al. | 128/201.19 |
| 3,347,230 | 10/1967 | Cupp | 128/201.19 |
| 3,348,539 | 10/1967 | McDonald | 128/201.19 |
| 3,521,626 | 7/1970 | Hashimoto et al. | 128/201.19 |
| 4,029,092 | 6/1977 | Morgan | 128/201.19 |
| 4,031,888 | 6/1977 | Walters | 128/201.19 |
| 4,071,110 | 1/1978 | Payne | 128/201.19 |
| 4,304,229 | 12/1981 | Curtin | 128/201.11 |
| 4,527,657 | 7/1985 | Payne | 128/201.19 |

FOREIGN PATENT DOCUMENTS 0122878 4/1984 European Pat. Off. .

OTHER PUBLICATIONS

Divecomm, Inc., Divecomm Model USC—101 Communicator Brochure, 1991.

*Primary Examiner*—Edgar S. Burr
*Assistant Examiner*—Aaron J. Lewis
*Attorney, Agent, or Firm*—Dalesman & Company

[57] ABSTRACT

A microphone mask to be worn in front of the mouth of an underwater diver has a microphone assembly and a teethpiece assembly mounted in a rubber waterproof enclosure. The enclosure has an air passage extending from an inlet opening to a rear outlet opening. The teethpiece assembly includes a plastic insert with a vertical plate mounted in the enclosure. The vertical plate has openings for the air passage as well as to allow sound to travel from the diver's mouth to the microphone assembly. A teeth member extends rearwardly out of the outlet opening into the diver's mouth where it is held between the diver's teeth. The teeth member is connected to the insert by resilient spring members which draw the enclosure rearwardly against the diver's face. There is a sealing surface around the outlet opening, and this seals it around the outside of the diver's mouth. This eliminates the need for a headband and facilitates the use of the microphone mask for the combination of breathing and speaking.

4 Claims, 3 Drawing Sheets

DIVER'S MICROPHONE MASK

BACKGROUND OF THE INVENTION

This invention relates generally to underwater diving apparatus and more particularily to a mouth mask to accomodate a microphone for underwater communication.

In the past, it has been well known to mount a diver's respirator on a mouthpiece which has teethpieces which are engaged between the diver's teeth to hold it in place. However, both the mouth piece and the teethpieces are in the diver's mouth, and the waterproof seal is between the mouthpiece and the inside of the diver's lips. An example of this is seen in Curtin U.S. Pat. No. 4,304,229. A similar arrangement providing for underwater communication between two divers is shown in European Patent Publication No. 0 122 878 to Gross filed Apr. 2, 1984. Disadvantages of this arrangement are that it is difficult to speak with the mouthpiece in the mouth and the air supply is interrupted if the mouthpiece is taken out of the mouth.

It is also known to provide a diver's mask with a microphone which is held in place in front of the diver's mouth by an elastic headstrap which extends around the back of the head of the diver. One example of this is shown in the Divecomm Model USC - 101 Communicator brochure. While this provides improved communication, the position of the headstrap is uncomfortable and it is inconvenient, particularly in association with another mask to cover the eyes.

SUMMARY OF THE INVENTION

Accordingly, it is an object of the present invention to at least partially overcome the disadvantages of the prior art by providing a diver's microphone mask to be worn in front of the diver's mouth without requiring a headstrap.

A further object of the invention is to provide an advantageous teethpiece assembly to hold the mask in this position with a waterproof seal against the diver's face.

To this end, in one of its aspects, the invention provides a microphone mask to be worn in front of the mouth of an underwater diver, comprising of a hollow waterproof enclosure with an inlet opening, an outlet opening, and an external sealing surface extending around the outlet opening, the inlet opening being connectable to an air supply, the outlet opening extending rearwardly to the mouth of the diver, the enclosure providing an air passage therethrough from the inlet opening to the outlet opening, the sealing surface being shaped to sealingly fit against the face of the diver around the mouth of the diver, a microphone assembly mounted in the enclosure to transmit a signal from sound received from the mouth of the diver, and a teethpiece means attached to the enclosure to extend rearwardly into the mouth of the diver, the teethpiece means being engageable by the teeth of the diver to retract the enclosure against the face of the diver with sufficient force whereby the enclosure is retained in place and the sealing surface seals against the face of the diver.

Further objects and advantages of the present invention will appear from the following description taken together with the accompanying drawings.

DETAILED DESCRIPTION OF THE INVENTION

Figure 1:
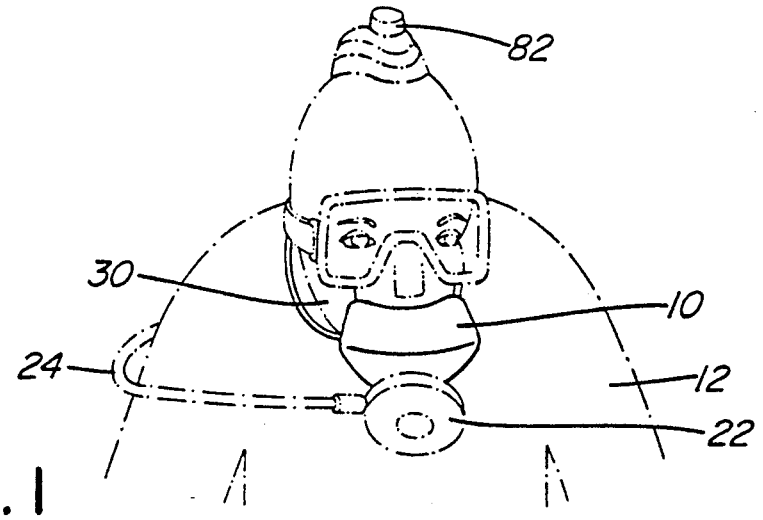
FIG. 1 is an isometric view of a diver wearing a microphone mask according to a preferred embodiment of the invention.
Figure 2:
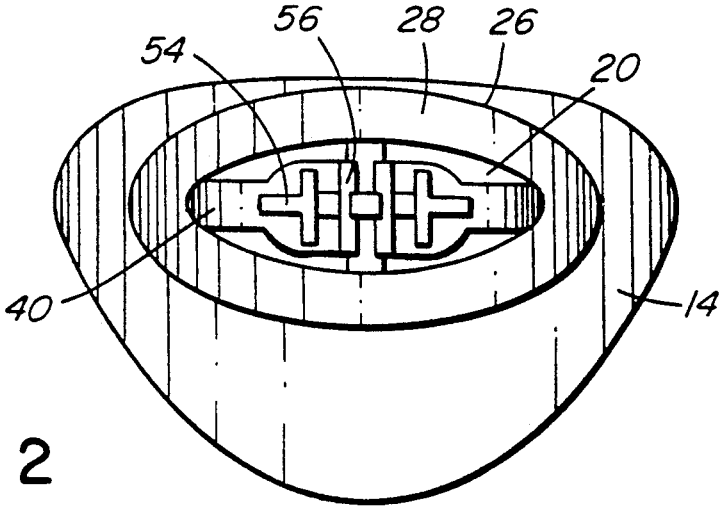
FIG. 2 is an isometric view showing the rear of the microphone mask seen in FIG. 1.
Figure 3:
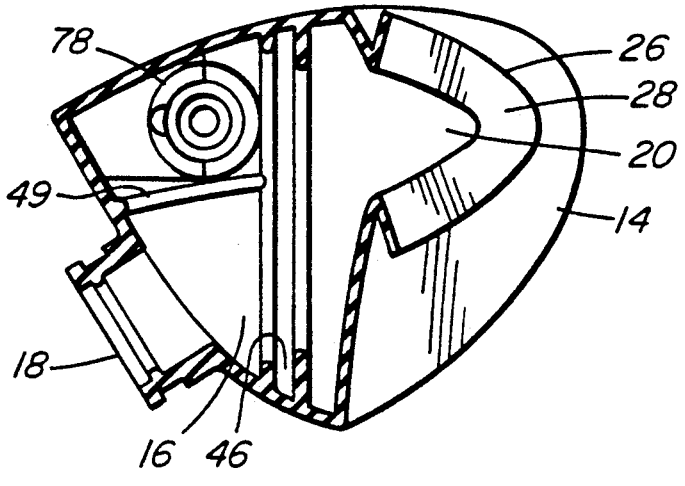
FIG. 3 is a cross sectional view of the waterproof enclosure of the microphone mask seen in FIG. 1.

Reference is first made to FIGS. 1, 2 and 3 which show a microphone mask 10 according to a preferred embodiment of the invention worn in front of the mouth of an underwater diver 12. The mask 10 has a waterproof enclosure 14 which, in this embodiment, is made of rubber. The enclosure 14 has an air passage 16 extending therethrough between an inlet opening 18 and an outlet. opening 20. A conventional scuba regulator 22 is connected to the inlet opening 18 to supply air received through an air line 24 from a portable tank (not shown). The outlet opening 20 extends rearwardly to the mouth of the diver 12 and in this embodiment, is shaped to fit the mouth of the diver 12. The enclosure 14 has a flexible flange portion 26 extending around the outlet opening 20 to provide an external sealing surface 28 which fits against the face 30 of the diver 12. Thus, the sealing surface 28 extends around the diver's mouth and seals against the diver's face 30, which term is used herein to include the lips of the diver.

Figure 4:
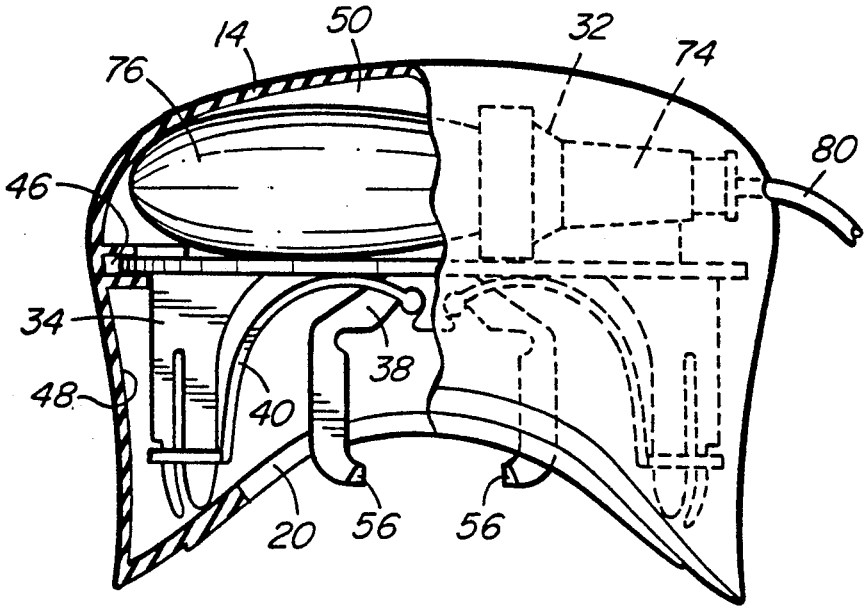
FIG. 4 is a partial sectional view of the same microphone mask showing the microphone and teethpiece assembly mounted in the waterproof enclosure.
Figure 5:
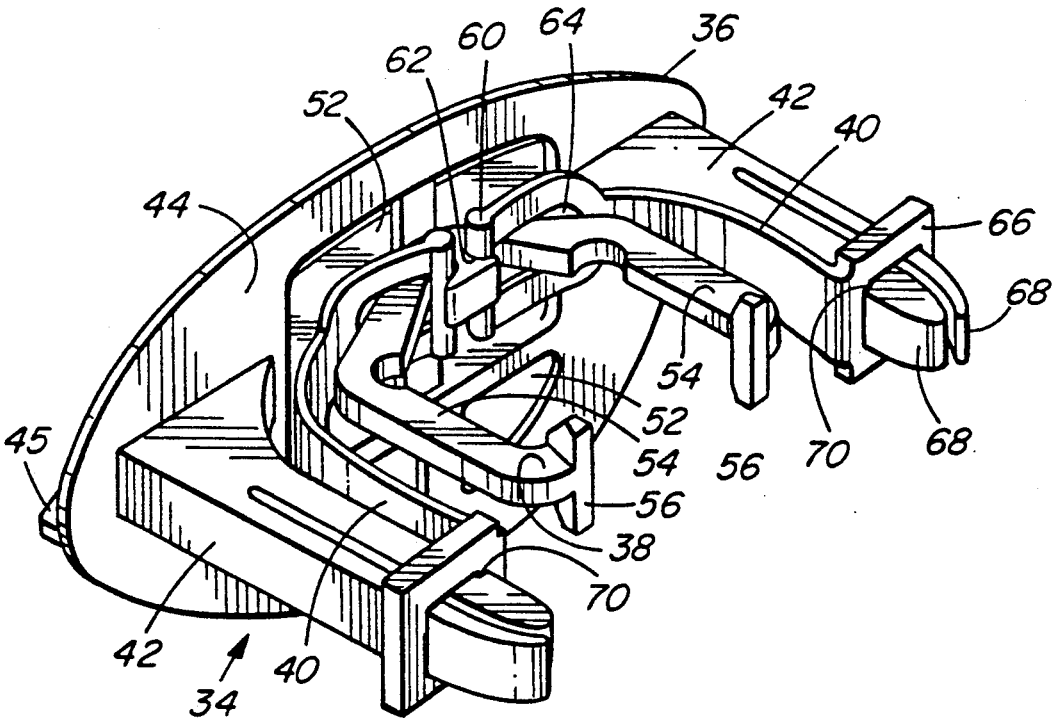
FIG. 5 is an isometric view of the teethpiece assembly seen in FIG. 4.

Reference is now made to FIGS. 4 and 5 which show a microphone assembly 32 and a teethpiece assembly 34 securely mounted in the enclosure 14. As best seen in FIG. 5, the teethpiece assembly 34 includes an insert 36, U - shaped teeth member 38, and a pair of curved spring members 40 which, in this embodiment, are all made of a suitable resilient plastic such as Delrin. The insert 36 has a pair of arms 42 extending rearwardly from a vertical plate 44. The insert 36 also has a horizontal plate 45 extending forwardly from the vertical plate 44. As can be seen, the arms 42 and plates 44, 45 of the insert 36 are shaped to fit snugly inside the rubber enclosure 14. The vertical plate 44 seats in a grove 46 formed around the inner surface 48 of the enclosure 14, and the horizontal plate sits on a ridge 49. Thus the insert 36 is securely mounted in the enclosure 14, with the plates 44, 45 forming a compartment 50 in which the microphone 32 is mounted. The vertical plate 44 has openings 52 therethrough to provide for the air passage 16 as well as for sound to travel from the diver's mouth to the microphone assembly 32.

Figure 6:
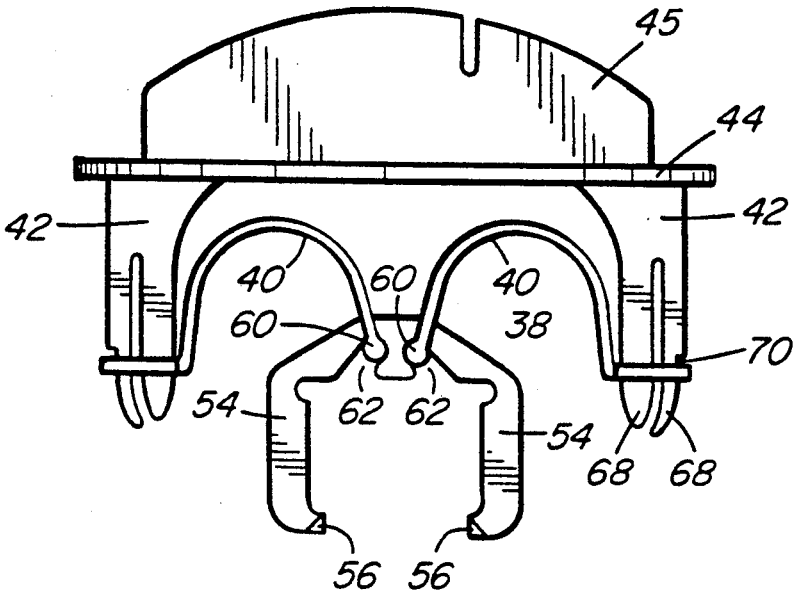
FIG. 6 is a plan view of the teethpiece assembly with the teeth member in the fully extended position.

The U - shaped teeth member 38 has a pair of spaced side portions 54 which extend rearwardly through the outlet opening 20 into the mouth of the diver 12. The diver's teeth close over vertically projecting flange portions 56 which are provided to facilitate engagement. The teeth member 38 is connected to the insert 36 by the two curved resilient spring members 40. The inner end 60 of each curved spring member 40 is seated in a matching slot 62 in the teeth member 38 and has a hole 64 through which one of the side portions 54 of the teeth member 38 extends. The outer end 66 of each curved spring member 40 fits over two resilient fingers 68 of one of the arms 42 of the insert 36 and is securely engaged in a groove 70. Thus, the teeth member 38 is resiliently mounted by the two spring members 40 between the arms 42 of the insert 36. While the teeth member 38 can be retracted as far as the position seen in FIG. 6, at rest the resiliency of the spring members 40 hold it in the position seen in FIGS. 4 and 5. As can be seen, in this rest position the teeth member 38 abuts against the vertical plate 44 of the insert 36 which prevents it from moving any further forward.

Figure 7:
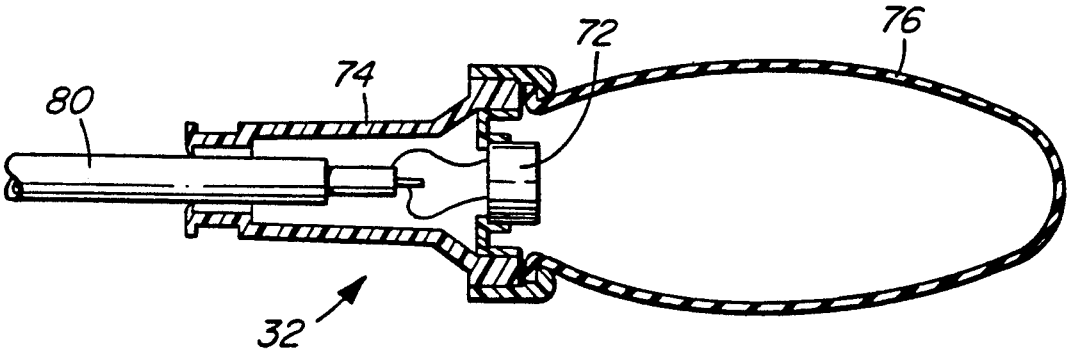
FIG. 7 is a sectional view showing the structure of the microphone.

As seen in FIG. 7, the microphone assembly 32 includes a microphone 72 which is mounted in a bracket 74 and covered by a flexible waterproof bladder 76. The bracket 74 is seated in a receptacle 78 molded in the enclosure 14 and a cable 80 extends out through the enclosure 14 to carry the signal to a transmitter 82 worn by the diver 12. The bracket 74 and the bladder 76 are waterproof to protect the microphone 72 if water enters the enclosure 14. The bladder 76 is flexible to allow for compression as the pressure increases at increased diving depths.

In use, the microphone mask 10 is assembled as shown and worn as seen in FIG. 1. The teeth member 38 is engaged between the teeth of the diver 12 and the resiliency of the spring members 40 draw the enclosure 14 rearwardly against the diver's face 30 with sufficient force to hold it in place. The structure of the teeth member 38 and spring members 40 shown in the embodiment have the advantage that the relationship of extension of the teeth member 38 to tension provided by the spring members 40 is non-linear. The shape of the sealing surface 28 and resiliency of the flange portion 26 of the enclosure 14 provide a waterproof seal against the face 30 of the diver 12. The provision of this teethpiece assembly 34 has the advantage of eliminating the necessity of using a headstrap, and the location of the seal outside the mouth allows the diver to enunciate quite clearly into the microphone 72. Of course, the structure of the enclosure 14 and the teethpiece assembly 34 facilitate the use of the microphone mask 10 for the combination of breathing and speaking. The vertical plate 44 of the insert 36 engages the rubber enclosure 14 and retains its shape, while the openings 52 through the vertical plate 44 provide the air passage 16 between the inlet opening 18 and outlet opening 20 as well as allow for sound to travel from the diver's mouth to the microphone assembly 32.

While the description of the microphone mask 10 has been given with respect to a preferred embodiment, it will be evident that various modifications are possible without departing from the scope of the invention as understood by those skilled in the art and as defined in the following claims. For instance, other structures of the teethpiece assembly 34 can be used. The sealing surface 28 can be provided around the diver's mouth without the flange portion 26. Other suitable materials may be used to make the enclosure 14 and different parts of the teethpiece assembly 34.

The embodiments of the invention in which an exclusive property or privilege is claimed are defined as follows:

1. A microphone mask to be worn in front of the mouth of an underwater diver, comprising:

(a) a hollow waterproof enclosure with an inlet opening, an outlet opening, and an external sealing surface extending around the outlet opening, the inlet opening being connectable to an air supply, the outlet opening extending rearwardly to the mouth of the diver, the enclosure providing an air passage therethrough from the inlet opening to the outlet opening, the sealing surface being shaped to sealingly fit against the face of the diver around the mouth of the diver, (b) a microphone assembly mounted in the enclosure to transmit a signal from sound received from the mouth of the diver, and (c) teethpiece means attached to the enclosure to extend rearwardly through the outlet opening into the mouth of the diver, the teethpiece means being engageable by the teeth of the diver and being sufficiently resilient to retract the enclosure against the face of the diver with sufficient force whereby the enclosure is retained in place and the sealing surface seals against the face of the diver.

2. A microphone mask as claimed in claim 1 wherein the teethpiece means includes an insert securely mounted in the inclosure, a teeth member extending rearwardly through the outlet opening to be engaged between the teeth of the diver, and spring connector means resiliently connecting the teeth member to the insert.

3. A microphone mask to be worn in front of the mouth of an underwater diver, comprising:

(a) a hollow waterproof enclosure with an inlet opening, an outlet opening, and an external sealing surface extending around the outlet opening, the inlet opening being connectable to an air supply, the outlet opening extending rearwardly to the mouth of the diver, the enclosure providing an air passage therethrough from the inlet opening to the outlet opening, the sealing surface being shaped to sealingly fit against the face of the diver around the mouth of the diver, (b) a microphone assembly mounted in the enclosure to transmit a signal from sound received from the mouth of the diver, and (c) teethpiece means attached to the enclosure to extend rearwardly through the outlet opening into the mouth of the diver, the teethpiece means being engageable by the teeth of the diver and being sufficiently resilient to retract the enclosure against the face to the diver with sufficient force whereby the enclosure is retained in place and the sealing surface seals against the face of the diver, the teethpiece means including an insert securely mounted in the enclosure, a teeth member extending rearwardly through the outlet opening to be engaged between the teeth of the diver, and spring connector means resiliently connecting the teeth member to the insert, the insert having a pair of arms extending rearwardly in the enclosure, the teeth member being U - shaped with a pair of rearwardly extending spaced side portions, and the spring connector means comprising a pair of curved resilient spring members, each spring member being connected between one of the arms of the insert and the teeth member whereby the teeth member is resiliently mounted between the arms of the insert with the side portions of the teeth member extending rearwardly through the outlet opening to be engaged between the teeth of the diver.

4. A microphone mask as claimed in claim 3 wherein the microphone assembly includes a microphone mounted in a flexible waterproof bladder.

* * * * *